United States Patent [19]

McGillivray et al.

[11] Patent Number: 4,738,567

[45] **Date of Patent: * Apr. 19, 1988**

[54] COMPLIANT JACKET FOR OFFSHORE DRILLING AND PRODUCTION PLATFORM

[75] Inventors: Terrence L. McGillivray, Santa Rosa; Thomas B. Coull, Hayward, both of Calif.

[73] Assignee: Bechtel International Corporation, San Francisco, Calif.

[ * ] Notice: The portion of the term of this patent subsequent to Jul. 8, 2003 has been disclaimed.

[21] Appl. No.: 852,060

[22] Filed: Apr. 15, 1986

[30] Foreign Application Priority Data

Apr. 19, 1985 [GB] United Kingdom ..... 8510057

[51] Int. Cl.[4] ..... E02B 17/00; E02D 21/00

[52] U.S. Cl. ..... 405/227; 405/202; 405/224

[58] Field of Search ..... 405/195, 202, 203–209, 405/224, 225, 227, 228; 166/335, 350, 366, 367; 175/5, 9

[56] References Cited

U.S. PATENT DOCUMENTS

| | | | |
|---|---|---|---|
| 3,685,300 | 8/1972 | Mott et al. | 405/227 |
| 3,987,636 | 10/1976 | Hruska et al. | 405/227 X |
| 4,117,690 | 10/1978 | Besse | 405/208 X |
| 4,363,568 | 12/1982 | Schuh | 405/227 |
| 4,378,179 | 3/1983 | Hasle | 405/224 X |
| 4,417,831 | 11/1983 | Abbott et al. | 405/227 |
| 4,505,620 | 3/1985 | Andrier | 405/202 X |
| 4,599,014 | 7/1986 | McGillivray et al. | 405/227 X |

OTHER PUBLICATIONS

1986 Platform Construction Report, Ocean Industry, Mar. 1986.

*Primary Examiner*—Dennis L. Taylor
*Attorney, Agent, or Firm*—Townsend and Townsend

[57] ABSTRACT

A jacket adapted to be mounted in an upright position in water depths in the range of 1000 to 1500 feet or more. The jacket has a number of spaced, generally parallel legs coupled together by braces, each leg being tubular to contain a plurality of sleeves and/or guides rigidly secured to the inner surface of the leg. Each sleeve has a tubular pile therewithin, the upper end of each pile being rigidly connected to the upper end of the sleeve, the piles extending downwardly through respective sleeves and into the sea bottom to provide a foundation for the jacket. Each pile serves as a compression spring to present tension-compression couples to withstand lateral forces during rocking motion of the upper end of the jacket relative to the lower end thereof. Each pile is further adapted to house a well for transfer of hydrocarbon or mineral products from the sea bottom to the platform on the upper end of the jacket. The legs have bulkheads to define air chambers to provide buoyancy to counteract vertical loads, such as the weight of the platform on the upper end of the jacket.

21 Claims, 3 Drawing Sheets

COMPLIANT JACKET FOR OFFSHORE DRILLING AND PRODUCTION PLATFORM

This invention relates to improvements in supports for offshore drilling and production platforms and, more particularly, to a tower for supporting such a platform in 1000- to 1500-foot water depths.

BACKGROUND OF THE INVENTION

As oil and gas reserves have been discovered in deeper water, attempts have been made by the oil industry to improve the cost effectiveness of offshore platforms without sacrificing their operational reliability and safety. For deep water operations, such as in water depths of 1000 feet, structural costs generally become more important factors of total field development costs than drilling, topside and transportation costs which dominate in shallow water operations.

In recent years, there have been advances in the availability of offshore construction equipment for large platforms. Such equipment has helped to extend water depth ranges of fixed based jackets to well beyond 1000 feet. Fixed based jackets are a proven base for conventional drilling and production; however, the cost for a structure itself in 1000 feet of water is often on the order of $100 to $150 million dollars, not including topside facilities, drilling or pipelines. This places a heavy economic burden on most oil and gas prospects in the Gulf of Mexico.

There is a clear need for more cost-effective platforms in greater water depths at which conventional drilling and production operations can be maintained with proven components with less material. This need will increase in coming years if fabrication yards are filled and the unit prices of steel fabrication continue to rise. The present invention provides a compliant jacket which fulfills this need and provides a cost savings of 20% to 30% over that achieved with fixed based jackets.

SUMMARY OF THE INVENTION

The present invention comprises a compliant jacket which includes a frame formed from four large-diameter main legs tied together with a simple, large-diameter cross-bracing system in both vertical and horizontal planes. The legs are tubular and each leg contains a number of sleeves or guides secured by shear plates to the inner surface of the leg. Each sleeve contains a tubular pile which is secured at its upper end to the upper end of the corresponding sleeve. Each pile extends outwardly from the lower end of the respective leg so that the pile can extend a considerable distance into the sea bottom to provide a foundation for the jacket.

Wells are drilled through all or at least some of the piles in the legs so that the piles serve as drive pipes for the wells. As a result, there are no exposed piles or a minimum or no exposed conductors on the associated framing. This feature reduces applied current and wave forces. Also, the jacket responds to waves in a compliant fashion due to its long rocking period of over 25 seconds without the need for guy lines.

The jacket of the present invention is cost-effective in the water depth range of about 1000 to 1500 feet. The foundation formed by the piles extending from the top of the jacket to about 300 feet into the sea bottom provides a soft or compliant foundation. This reduces the effects of wave and water current forces by providing an increased rocking period which decreases dynamic wave forces.

A primary feature of the compliant jacket of the present invention is its relatively simple frame with reduced steel tonnage compared to the structure of a fixed based platform. The jacket may be designed to be side launched or end launched, using the main side or horizontal frames as launch trusses.

Inherent in the main legs and bracing is a large amount of buoyancy which can be used to offset payload and structure weight and to achieve the desired foundation reaction. It is possible that any part of each jacket leg can be deballasted for in-place conditions. Water-tight bulkheads at each framing level plus continuous sleeves for housing the piles in the jacket legs extend through the buoyant zone to provide safety against accidental flooding.

A primary object of the present invention is to provide a compliant jacket for supporting an off-shore drilling and production platform wherein the jacket is highly cost-effective, is especially suitable for use in water depths in the range of 1000 to 1500 or more feet, and is capable of withstanding wind, wave and water current forces in a compliant fashion by virtue of the use of long, tubular piles which extend along the length of the jacket and into the sea bottom to provide a compliant foundation for the jacket.

Other objects of this invention will become apparent as the following specification progresses, reference being had to the accompanying drawings for an illustration of an embodiment of the invention.

DETAILED DESCRIPTION OF THE PREFERRED EMBODIMENT

Figure 2:
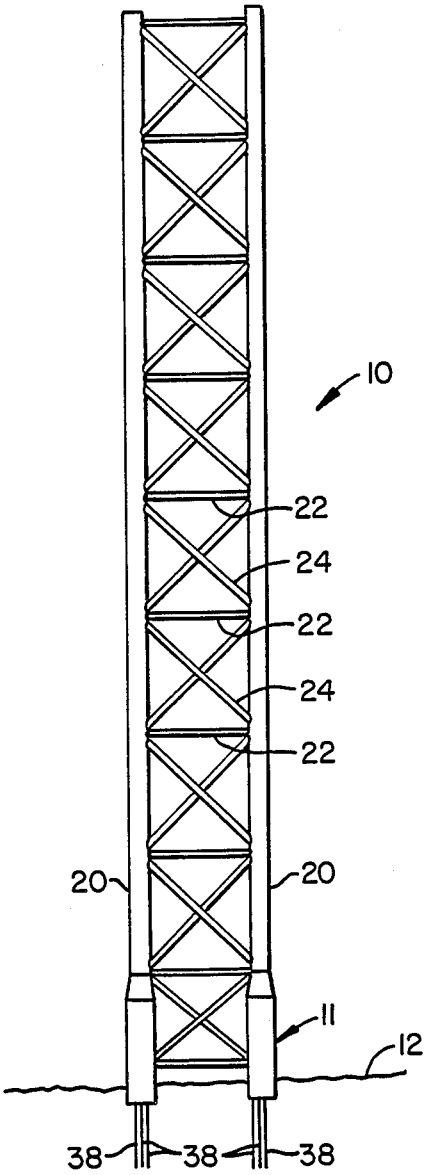
FIG. 2 is a side-elevational view of the compliant jacket with the platform removed.

The compliant jacket of the present invention is broadly denoted by the numeral 10 and is adapted to be mounted in water depths of 1000 to 1500 feet or more. When properly mounted, jacket 10 is in an upright position with the lower end 11 of the tower embedded in the sea floor below the mud line 12 (FIG. 2). When the jacket is in its operating position, it mounts a platform or deck 14 above the mean water line. Deck 14 is provided with equipment for drilling wells into the sea floor and for providing a means for receiving hydrocarbon products flowing through the wells during production operations. In its erected position as shown in FIG.

1, jacket 10 needs no guy lines for support against wind, wave and water current forces.

The length of the jacket is selected so that deck 14 is typically well above the mean water level, and the lower ends of the legs of the jacket 10 extend slightly into the mud below the mud line. The jacket as hereinafter described is provided with a number of piles which extend even further downwardly below the mud line 12, such as to a distance of about 300 feet. Wells or well casings hereinafter described are housed in the piles. These wells can extend well below the lower ends of the piles, such as to depths of 5,000 to 15,000 feet into the earth below the mud line.

Figure 3:
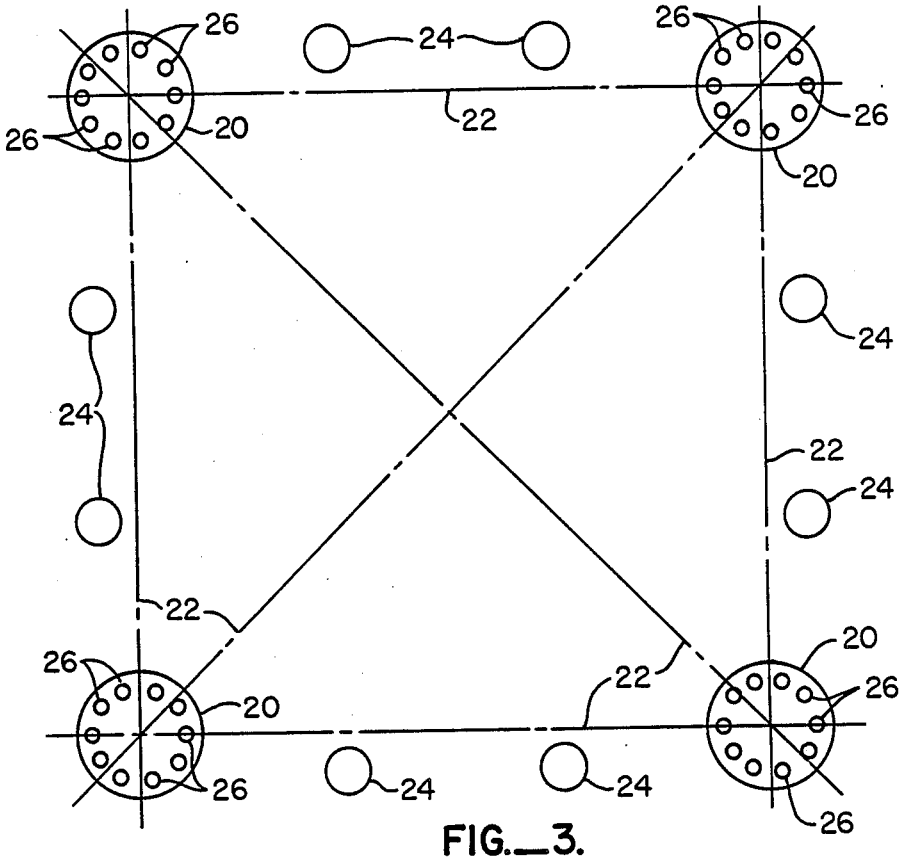
FIG. 3 is a schematic plan view of a horizontal section of the tower, showing the legs and the sleeves within the legs for containing piles which are driven into the sea bottom to provide a foundation for the jacket.

Jacket 10 includes four large diameter legs 20 which are arranged relative to each other in the manner shown in FIG. 3. The legs are at the corners of the jacket as shown in FIG. 3, and the legs are generally parallel with each other. The diameter of each leg typically is about 12 to 16 feet, the lower end of each leg being generally larger in diameter than the upper, major portion of the leg, the lower portion of the leg typically having a diameter in the range of 20 to 25 feet.

The four legs 20 are tied together with a simple, large diameter cross-bracing system in both vertical and horizontal planes. In FIG. 3, the horizontal braces are denoted by the numeral 22, the inclined braces being denoted by the numeral 24 (FIG. 2). The braces provide an increase in the stability of the tower and compensate for lateral loads exerted on the foundation due to wind, wave action and water currents. At the bottom of the jacket, shear piles 23 (FIG. 1) in sleeves 24 (FIG. 3) can be used to supplement the lateral resistance of the jacket foundation to be described.

Figure 4:
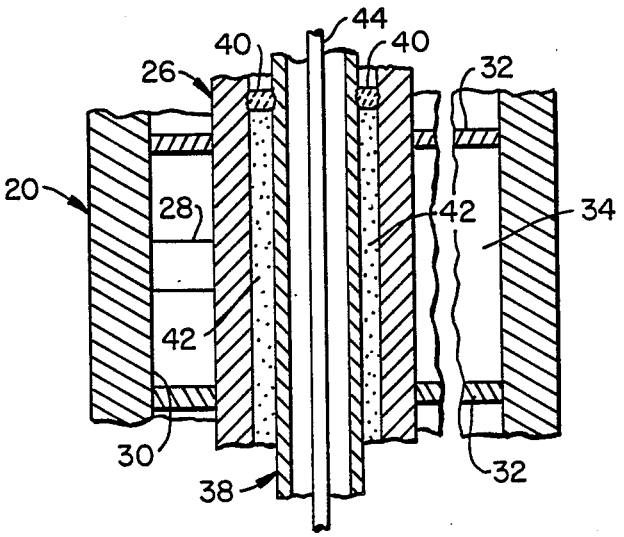
FIG. 4 is an enlarged, fragmentary cross-sectional view of one of the jacket legs showing a sleeve therein for housing a pile and a well in the pile.

Each leg 20 has a plurality of generally vertical sleeves 26 therein as shown in FIGS. 3 and 4. For purposes of illustration, the sleeves 26 in FIG. 3 are shown as surrounding the central axis of the leg in a circular pattern; however, the sleeves could be arranged in any desired pattern within the leg.

Each sleeve 26 is connected by a shear plate 28 (FIG. 4) to the inner surface 30 of the corresponding leg 20. Thus, the sleeves are rigidly coupled to the corresponding leg and sleeves or pile-conductor guides extend throughout the length of the leg.

Each leg can be provided with a plurality of vertically spaced, horizontal bulkheads 32 secured to the sleeves and connecting the sleeves to the inner surface 30 of the corresponding leg. Thus, each plate 32 is disc-shaped and is welded or otherwise fastened to and surrounds each sleeve 26 to rigidify the sleeve. The horizontal plates 32 divide each leg into a series of vertically extending, end-to-end, closed air chambers 34 for providing buoyancy for the jacket. The buoyant chambers 34 contain air and are out of fluid communication with each other. However, jacket 10 can be provided with a piping system (not shown) so as to permit the various buoyant chambers 34 to be opened to the atmosphere or caused to be flooded with sea water to reduce the buoyancy. Such piping system is controlled from platform 14 at the top of the jacket.

Figure 1:
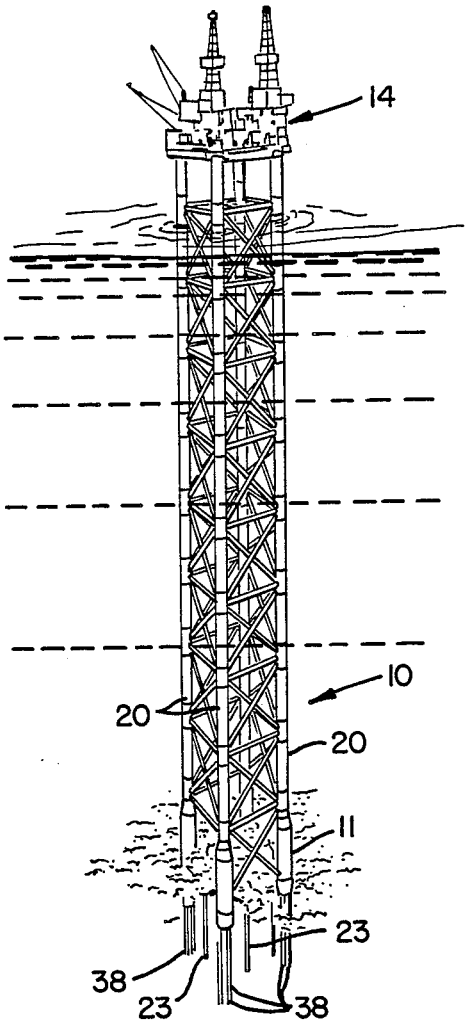
FIG. 1 is a perspective view of the compliant jacket of the present invention, the jacket being shown in an operating position for supporting a drilling and production platform above the mean water level of the sea.

Each sleeve 26 is provided with a tubular resilient pile 38 which extends through the sleeve throughout the entire length of the sleeve and projects outwardly from the lower end of the sleeve and beyond the lower end of the corresponding leg 20 as shown in FIGS. 1 and 2. Thus, when the jacket 10 is in its operative position as shown in FIG. 1, the piles 38 will extend into the sea well below the mud line 18, such as to a depth of 300 feet or more.

Each pile 38 is secured at its upper end to the respective sleeve by welding at locations 40 and by grouting 42 in an upper, annular space between the sleeve and the pile.

Each pile 38 serves as a compression spring for the corresponding leg 20 since the pile is made of a resilient steel tube. This construction of a compression spring provided by each pile provides an upwardly directed restoring force which tends to counteract the downward force of the weight of the platform. The piles 38 provide for compression and tension forces which develop tension-compression couples to counteract the rocking motion of the tower about the foundation due to wind, wave and water current forces.

Each pile can receive a well 44 extending downwardly from deck 14, through the pile and out of the bottom end of the pile into the sea bottom to a depth at which hydrocarbons to be produced are located. Thus, each pile 38 provides a conductor for housing the corresponding well and the piles thereby protect wells 60 from the damaging effects due to waves and water currents.

Jacket 10 is fully supported in its operational position by the buoyant air chambers 34 and by the foundation defined by the lower ends of legs 20 and by piles 38 which extend into the sea bottom. Thus, guy lines are not needed to further stabilize the jacket.

In use, when jacket 10 is erected as shown in FIG. 1, piles 38 extend downwardly through respective sleeves 26 and into the sea bottom, typically to a depth of 300 feet or more. Once the piles are in place, drilling operations can be conducted to place wells 44 in respective piles 38. Once the wells are in place, production of hydrocarbons or other minerals may commence and continue over a long period of time.

Tower 10 resists wind, wave and current forces by the following two reactions: the reaction due to the restoring force of the foundation of the lower part of the jacket, and the buoyancy force provided by air chambers 34. The foundation provides restoring forces because the piling 38 is located in the corners of the structure inside the main legs and extends into the sea bottom for a considerable distance. When wind, wave and current forces are applied to the jacket, the pilings develop tension-compression couples which serve to resist wave forces. The buoyancy chambers 34 provide a large restoring force to the platform and overcome the weight thereof. The jacket responds to waves in a compliant fashion due to its long rocking or swaying period of over 25 seconds. The flexural period of the jacket is generally less than 4.0 seconds.

Since the piles 38 are within the main legs 20 of the jacket, there are no exposed conductor guides or pile sleeves. Pipeline risers, casings and J-tubes are housed outside the main legs in a conventional manner.

Piles 38 are clustered in the respective sleeves 26, and the group effects of the piles of such clusters can be minimized by initiating a slight curvature of approximately 1.5 degrees per one hundred feet in the bottom bay of the jacket. This provides an initial offset as the piles enter the sea bottom. Although some group effects will exist in the top 50 to 100 feet of the soil, this is not a serious penalty as there is not much axial capacity in this top region of soil.

In addition to the main piles 38, there may be a requirement for shear piles 23 (FIG. 1) in soft soil areas.

These shear piles would be designed to resist lateral loads only and hence would not be grouted or connected to the shear pile guides 24 (FIG. 3) framed to the base of jacket 10. These shear piles can be pre-installed in jacket 10 and driven down by small diameter followers from the surface, thus minimizing installation time.

Piles 38 are contained within legs 20 to reduce wet water current and wave forces on the piles. Both a one-rig or two-rig arrangement is feasible with wells in two legs; however, two rigs are anticipated if all four platform legs are used for wells. Piles 38 can be pre-installed in the fabrication yard, thus saving installation time offshore. Since jacket 10 has a large amount of reserve buoyancy due to buoyant chambers 34, the installation of piles 38 does not create a flotation or upending problem.

The design of fixed based jackets in deep water requires a low rocking period to avoid dynamic amplification of design waves and fatigue problems due to common sea conditions. The compliant jacket 10 of the present invention uses the opposite approach in the sense that the rocking period is designed to be longer than the extreme wave periods. This provides a reduction of peak design wave forces. In addition, the relative velocity of the jacket to wave particles is significant and reduces the applied forces. The long period rocking mode response of jacket 10 results in the inertial forces opposing and effectively balancing peak applied wave forces.

The flexural period of jacket 10 is also important and must be kept low to avoid excitation by every day sea conditions and their potential fatigue complications. The flexural period of jacket 10 is about 2.5 to 4.0 seconds, which is well out of the range of significant wave energy. The deck motions are acceptable and many cases superior to deep water fixed based jackets for every day sea conditions. This is due to the fact that the sea conditions in the 4 to 8 second range, which do not excite the compliant jacket natural periods, tend to excite the rocking period of large fixed base jackets.

An initial assessment of the response of jacket 10 to operational and extreme conditions was made. Two different water depths, namely 1000 feet and 1400 feet were selected for study. A three-dimensional computer model of compliant jacket 10 was developed for the dynamic analysis program SEARISER. The model explicitly included all major framing, shear piles, and a total of 48 piles in the four legs of the jacket, each pile being about 26 inches in diameter. The mass of the completed wells, deck, topside and enclosed sea water was lumped at major framing levels.

Environmental conditions representative of a one hundred year and a one year return period Gulf of Mexico storm were used to determine the performance characteristics of the structure. A series of linear airy waves, combined with the storm current and wind, were run to estimate peak response. Results are shown in the following table:

TABLE 1

| | 1000' Water Depth | | 1400' Water Depth | |
|---|---|---|---|---|
| | 100 Year Storm | 1 Year Storm | 100 Year Storm | 1 Year Storm |
| Wave Height (ft) | 74.00 | 30.00 | 74.00 | 30.00 |
| Wave Period (sec) | 13.30 | 8.00 | 13.30 | 8.00 |
| Maximum Lateral Deck Displacement (ft) | 24.10 | 5.80 | 37.20 | 9.20 |
| Maximum Tower Rotation (degrees) | 1.23 | 0.30 | 1.25 | 0.30 |
| Maximum Lateral Deck Acceleration (q) | 0.05 | 0.01 | 0.03 | 0.01 |
| Sway Period (sec) | 27.30 | 27.30 | 44.00 | 44.00 |
| Flexural Period (sec) | 2.80 | 2.80 | 3.80 | 3.80 |

Figure 5:
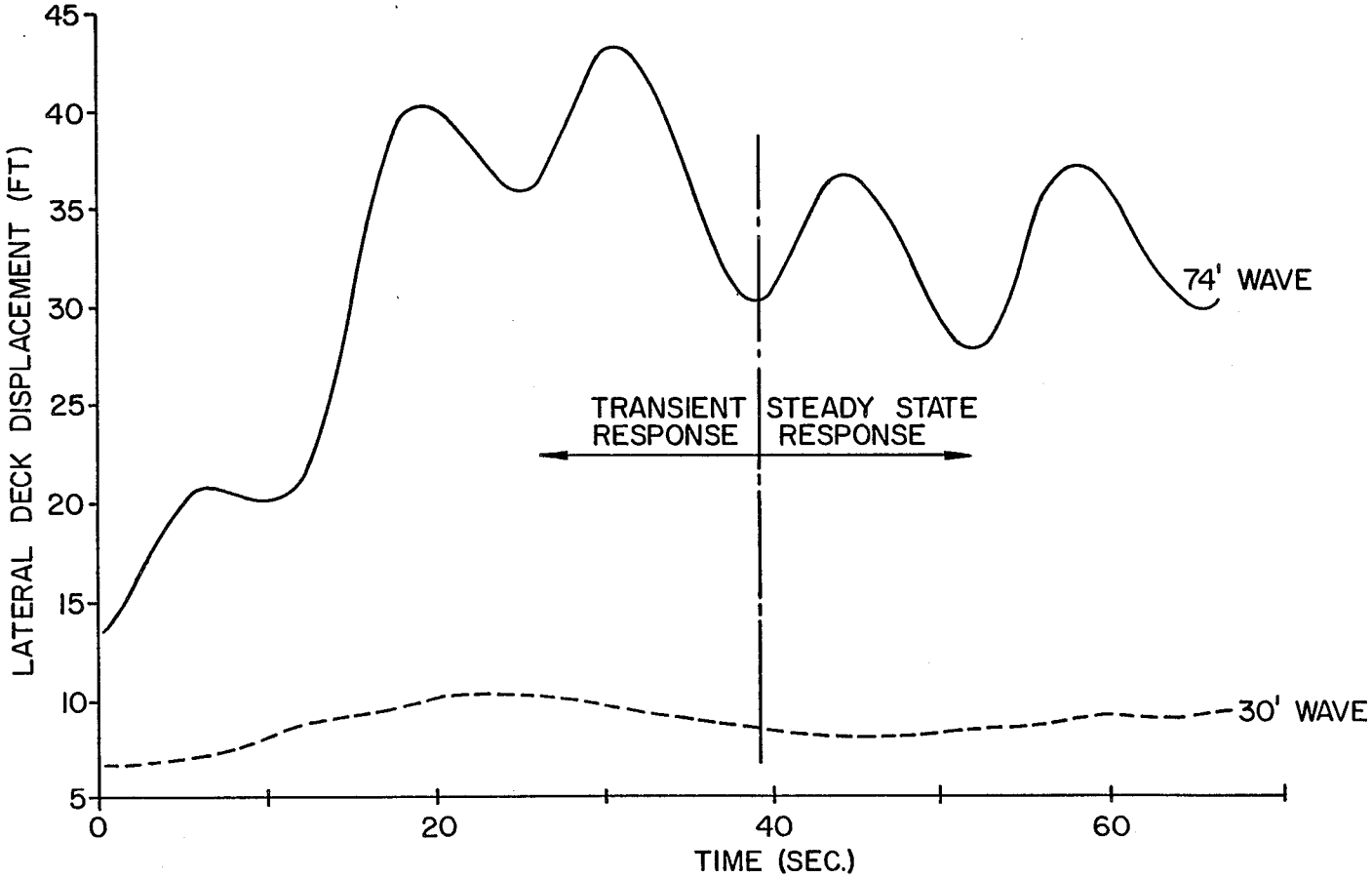
FIG. 5 is a curve showing lateral deck displacement at the top of the tower versus time for waves of two different heights, illustrating the efficiency of the jacket of the present invention.

Shown in FIG. 5 is the deck lateral displacement response for the 1400-foot water depth example of Table 1.

The results in Table 1 and FIG. 5 show that the response of jacket 10 to extreme sea conditions gives peak displacements, accelerations and forces well within acceptable design levels. However, platform response to operations sea conditions indicates that the jacket is a very stable drilling and production platform.

Reduced fabrication cost is the primary area of cost savings in compliant jacket 10. In addition to a reduced jacket fabrication cost, there is no piling cost per se if all of the piles 38 are used for wells. It is possible that the jacket weight will be one-half to two-thirds of a fixed based platform and of this weight, the legs 20 constitute 50% to 60% of the total.

As fabrication yards nearby to the installation site may be filled, the final assembly space for large jackets 10 would be of a real premium. One of the benefits of the compliant jacket 10 is that the legs 20 thereof can be fabricated off-site, at another location in the same yard, at another fabrication facility nearby, or even in an overseas shipyard and shipped in by barge. This will reduce the actual assembly time at the final assembly position adjacent to the water front to a minimum.

We claim:

1. Apparatus for supporting an offshore drilling and production platform comprising:

a jacket adapted to be mounted without guylines in an operative, generally upright position on the sea bottom and to extend upwardly to a location above the mean water level of the sea, the upper end of the jacket adapted to be coupled to the platform in supporting relationship thereto, said jacket having a plurality of spaced legs, at least one of the legs being tubular and having buoyant chamber means for exerting a buoyant restoring force on the jacket when the jacket is in said operative position thereof, there being a tubular pile extending into and through said one leg, the pile being secured at its upper end to said one leg near the upper end of said one leg, said pile extending outwardly and downwardly from the lower end of said one leg, whereby the lower end of the pile can extend into the sea bottom when the jacket is in said operative position, said pile adapted to receive a well extending downwardly from the platform when the platform is mounted on and supported by the upper end of the jacket, the well adapted to extend into the sea bottom for production of resources from a location below the sea bottom.

2. Apparatus as set forth in claim 1, wherein said one leg is provided with a series of generally end-to-end buoyant chambers defining said chamber means.

3. Apparatus as set forth in claim 1, wherein the pile is formed of steel to provide for the formation of tension-compression couples to counteract the rocking motion of the jacket when the jacket is in said operative position.

4. Apparatus as set forth in claim 1, wherein the one leg has a rigid sleeve therewithin, there being plate means for securing the sleeve to the inner surface of said one leg, said pile being within and secured at its upper end to said sleeve.

5. Apparatus as set forth in claim 4, wherein the sleeve has a length up to the the same as that of said one leg.

6. Apparatus as set forth in claim 5, wherein the pile is secured by welding and grouting to said sleeve.

7. Apparatus as set forth in claim 1, wherein the jacket has a length sufficient to permit it to be placed in water depths in the range of 1000 to 1400 feet.

8. Apparatus as set forth in claim 7, wherein the sway period and the flexural periods of the jacket are approximately 27.30 and 2.80 seconds, respectively, when the jacket is in a water depth of approximately 1000 feet.

9. Apparatus as set forth in claim 7, wherein the sway period and flexural period of the jacket are approximately 44.00 and 3.80 seconds, respectively, when the jacket is in a water depth of approximately 1500 feet.

10. Apparatus for mounting an offshore drilling and production platform above the water level of the prevailing sea comprising:

a jacket having an upper end and a lower end, the jacket adapted to be mounted without guylines in an upright position with the lower end supported on the sea bottom and with the upper end spaced above the water level of the sea, said jacket having a plurality of spaced, tubular legs, the lower ends of the legs adapted to extend into the sea bottom through a first distance when the tower is in said operative position;

means in each of said legs for providing a number of buoyant chambers therefor;

a plurality of spaced, rigid sleeves in each leg, respectively, the sleeves of each leg being generally parallel with each other and extending longitudinally of the respective leg, there being means rigidly connecting the sleeves to the inner surfaces of respective legs; and a tubular pile for each sleeve, respectively, each pile being secured at its upper end to the upper end of the respective sleeve, each pile extending through the respective sleeve and outwardly from the lower end of the respective leg through a second distance greater than said first distance, each pile adapted to receive and house a well extending from said platform to and into the sea bottom to a location below the lower end of the respective pile when the jacket is in said operative position, whereby resources below the sea bottom can be produced and directed through the well to the platform.

11. Apparatus as set forth in claim 10, wherein each pile is formed from a resilient material.

12. Apparatus as set forth in claim 11, wherein said material is steel.

13. Apparatus as set forth in claim 10, wherein the upper end of the pile is near the upper end of the respective sleeve and is secured by welding and grouting to the respective sleeve.

14. Apparatus as set forth in claim 10, wherein the length of the tower is sufficient to allow it to be placed in water depths of 1000 to 1500 feet.

15. Apparatus as set forth in claim 14, wherein the sway period and flexural period are approximately 27.30 and 2.80 seconds, respectively, when the jacket is in a water depth of approximately 1000 feet.

16. Apparatus as set forth in claim 14, wherein the sway period and flexural period are approximately 44.0 and 3.80 seconds, respectively, when the jacket is in a water depth of approximately 1400 feet.

17. Apparatus as set forth in claim 10, wherein the buoyant chambers of each leg are in end-to-end relationship to each other.

18. A jacket adapted to be mounted without guylines in an operative, generally upright position at an offshore location where there exists a sea bottom and water characterized by mean water level, comprising:

a plurality of at least four legs each having a bottom and a top, sized to extend from the sea bottom to a level above the mean water level;

bracing means for maintaining said legs in a spaced, parallel relationship;

buoyant means, rigidly coupled to said legs, for exerting a buoyant restoring force on the jacket when the jacket is in the operative position;

a plurality of tubular piles each having an upper and a lower end, each leg having at least on of said piles associated therewith and extending therealong;

means for securing said piles near their respective upper ends to their associated legs at respective positions significantly spaced from the bottoms of the associated legs, said piles being of sufficient length to extend significantly beyond the bottoms of the associated legs and thus significantly below the sea bottom when the jacket is in the operative position; and guide means, carried by each of said legs, for maintaining said piles in a spaced, generally parallel relationship to their associated legs while allowing relative axial motion.

19. The jacket of claim 18 wherein said plurality of legs comprises four legs in a square array.

20. The jacket of claim 18 wherein each of said piles is formed of steel to provide for the formation of tension-compression couples to counteract rocking motion of the jacket when the jacket is in its operative position.

21. The jacket of claim 18 wherein each of said piles is located within its associated leg.

* * * * *